United States Patent [19]

Herbst

[11] 4,108,045

[45] Aug. 22, 1978

[54] WEAPON MOUNTING ARRANGEMENT

[75] Inventor: Rolf Herbst, Obervellmar, Germany

[73] Assignee: Thyssen Industrie Aktiengesellschaft, Essen, Germany

[21] Appl. No.: 168,362

[22] Filed: Aug. 2, 1971

[51] Int. Cl.[2] ..... F41H 5/20

[52] U.S. Cl. ..... 89/36 K; 89/37 E; 89/41 T

[58] Field of Search ..... 89/36 K, 37 E, 37 G, 89/37.5 R, 40 B, 41 T, 41 CE, 37.5 A; 114/5, 6, 7, 8

[56] References Cited

U.S. PATENT DOCUMENTS

| | | | |
|---|---|---|---|
| 734,779 | 7/1903 | Vivian | 89/37 G |
| 3,126,791 | 3/1964 | Chiabrandy | 89/37.5 |

*Primary Examiner*—Stephen C. Bentley

*Attorney, Agent, or Firm*—Spencer & Kaye

[57] ABSTRACT

A cardanically suspended movable turret having a tubular weapon mounted therein so that the bore axis of the barrel of the weapon intersects the vertical rotational axis of the turret and lies in between the elevation axis of the turret suspension and the center of gravity of the turret. By moving the bore axis closer to the center of gravity in this manner, the torque exerted on the turret during firing as a result of the recoil force is reduced.

3 Claims, 1 Drawing Figure

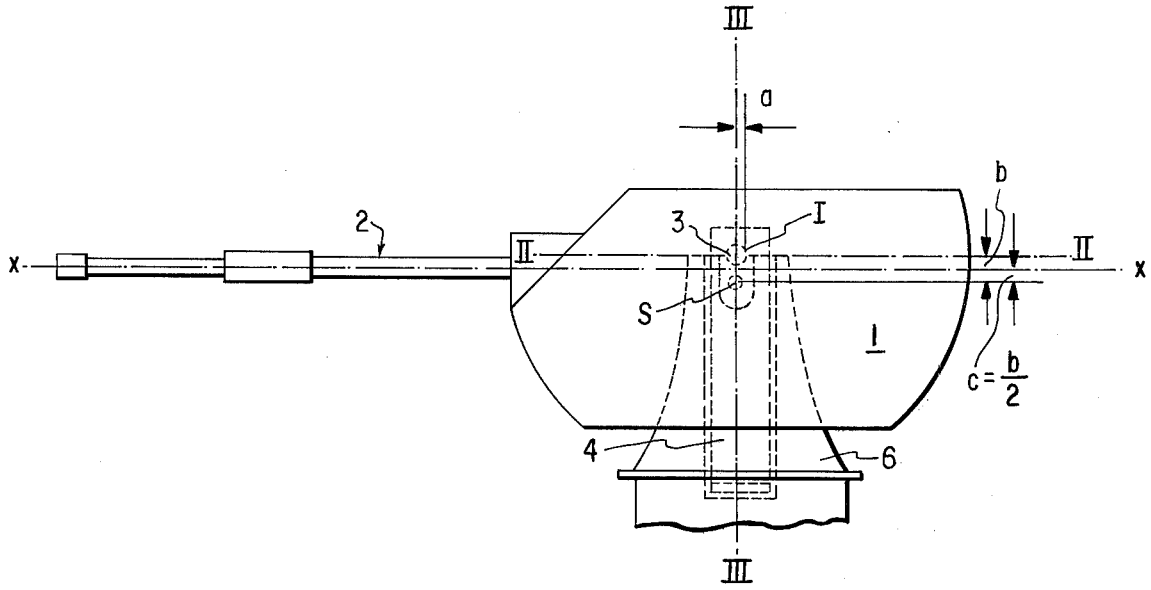
III
a
b
2
3
I
II
II
x
x
S
1
c = b/2
4
6
III

WEAPON MOUNTING ARRANGEMENT

BACKGROUND OF THE INVENTION

The present invention relates to a cardanically suspended turret having a tubular weapon mounted therein so that the bore axis of the barrel of the weapon intersects the vertical rotational axis of the movable turret.

In cardanically suspended and usually also triaxially stabilized turrets it is necessary to prevent any torque from influencing the turret during firing in order to obtain high stabilization accuracy of the weapon.

To prevent the torque caused by the firing in cardanically suspended turrets, it is known to dispose the tubular weapon in the turret in such a manner that the effective path of the recoil force intersects the elevation axis of the turret suspension. However, since the turret suspension cannot be constructed to be completely rigid and since the center of gravity of the turret changes its position due to the turret design and the variable amounts of ammunition stored in the turret so that it may be disposed, for example, below the elevation axis in the fully armed state and above the elevation axis when almost all of the ammunition has been fired, i.e. above the effective path of the recoil force of the tubular weapon, a torque acting on the turret during firing is still produced using this arrangement. This torque is determined by the distance of the center of gravity from the effective path of the recoil force of the tubular weapon, in this case, the elevation axis, and by the recoil force acting on the turret during firing.

SUMMARY OF THE INVENTION

It is the object of the present invention to provide a cardanically suspended turret having a tubular weapon mounted therein in such a manner that the torque occurring during firing is reduced.

This is accomplished according to the present invention in that the weapon is mounted in the turret so that the bore axis of the barrel of the weapon, which also represents the effective path of the recoil force, intersects the vertical rotational axis of the turret suspension and lies in between the elevation axis of the turret suspension and the center of gravity of the turret.

According to a preferred embodiment of the present invention, and with a vertical spacing between the elevation axis of the turret suspension and the center of gravity of the turret along the vertical rotational axis of the turret, the tubular weapon is mounted in the turret so that the vertical distances between the center of gravity and the bore axis of the barrel and between the bore axis of the barrel and the elevation axis of the turret suspension are approximately equal.

According to a further feature of the invention, the tubular weapon is mounted in the cardanically suspended turret so that the stronger the recoil moment of the weapon, the closer the bore axis of the barrel is moved to the center of gravity of the turret.

BRIEF DESCRIPTION OF THE DRAWING

The FIGURE is a schematic side elevation of a cardanically suspended turret having a weapon mounted therein according to the invention.

DESCRIPTION OF THE PREFERRED EMBODIMENT

In the illustrated embodiment, there is shown a cardanically suspended spherical turret 1 which is provided with a tubular weapon 2. In a conventional manner, the turret 1 is suspended in a gimbal or tilt bearing 4 by means of a pair of diametrally opposed trunnions 3. The horizontal axis I formed by the two trunnions 3 constitutes the elevation axis of the turret 1. The toroidal tilt bearing 4 is supported in a known manner on both sides via ball bearings in a housing 6, which is connected with the azimuth bearing (not shown) so that the turret 1 can be pivoted about a second horizontal axis II, i.e., the tilt axis of the cardanic suspension. The housing 6 fastened to the rotatable inner ring of the azimuth bearing can be rotated together with the tilt bearing 4 and the turret 1 about a vertical axis III, i.e., the vertical rotational or azimuth axis of the turret suspension. Axes I, II and III are imaginary geometrical directions in space with reference to the base (not shown), i.e., the vehicle or the like, in such a manner that axes I and II are horizontal and axis III is vertical as is conventional with such cardanic suspensions.

In such a weapon arrangement, the bore axis X of the barrel 5 of the weapon 2 is also the effective path of the recoil force for the weapon and intersects the vertical rotational axis III of the turret suspension. As clearly illustrated, according to the invention, the weapon 2 is mounted in the turret 1 so that, contrary to the prior art weapons arrangements, the bore axis X does not pass through the elevation axis I, i.e., the point of cardanic suspension, but rather lies in between the elevation axis I and the center of gravity S of the turret 1, i.e., in the illustrated embodiment below the point of cardanic suspension.

In the exemplary illustration of the invention, the turret is designed so that in its horizontal position the center of gravity S of the turret 1 is always located at a vertical spacing b along the rotational axis III from the horizontal elevation axis I of the turret suspension, i.e., below the elevation axis. According to the preferred embodiment of the invention, mounting of the tubular weapon 2 in the turret 1 is so selected that the distance $c$ between the center of gravity S and the bore axis of the barrel 5 is approximately equal to the distance between the bore axis X and the horizontal elevational axis I of the turret suspension.

As mentioned above, the center of gravity of the turret changes depending on the amount of ammunition stored in the turret and consequently moves between a first position when the turret is fully loaded with ammunition and a second position when all of the ammunition has been spent, i.e., unloaded. Accordingly, the average position of the center of gravity between these two extremes is preferably used in determining the location of the bore axis of the weapon 2.

With this arrangement, during firing the turret 1 recoils by a distance $a$ due to the elasticity of the bearing 4. The torque acting on turret 1 during firing in the elastic starting range of the bearing 4 results from the recoil force multiplied by the distance from the center of gravity $c = (b/2$. Consequently, since with a weapon arrangement according to the invention the distance from the center of gravity S has been reduced by about one-half as compared with a weapon disposed in the center of the turret, the torque is only about half as large.

According to a further feature of the invention, the torque acting on the turret during firing is further reduced in that the relative recoil force of the weapon is taken into consideration at the time the weapon 2 is mounted in the turret. In particular, the larger the recoil force of the particular weapon 2, the closer the bore axis is positioned to the center of gravity S, and consequently the farther, within the limits of the invention, from the elevation axis I.

It will be understood that the above description of the present invention is susceptible to various modifications, changes and adaptations and the same are intended to be comprehended within the meaning and range of equivalents of the appended claims.

I claim:

1. In a cardanically suspended movable turret having a tubular weapon mounted therein so that the bore axis of the barrel of said weapon intersects the vertical rotational axis of said movable turret and a center of gravity which is always vertically displaced from and below said bore axis of the barrel of said weapon and the elevation axis of the cardanic suspension of said turret, but which moves between a first position when the turret is fully loaded with ammunition and a second position when the turret contains no ammunition, the improvement wherein said weapon is mounted in said turret so that said bore axis of the barrel of said weapon lies in between said elevation axis of the cardanic suspension of said turret and said center of gravity of said turret, and when said turret and said weapon are aligned so as to cause said center of gravity to be vertically displaced from said elevation axis of the turret suspension along said vertical rotational axis, the vertical distance along said vertical rotational axis between said bore axis and said elevation axis is approximately equal to the vertical distance along said vertical rotational axis between said bore axis and the average position of said center of gravity of said turret whereby the effective path of the recoil force of said weapon, which path is along the bore axis of said weapon, is moved toward the center of gravity of said turret and consequently the torque exerted on the turret during the firing is reduced.

2. In a movable turret which is mounted on a base and is cardanically suspended for movement about three axes which intersect at the cardanic suspension point, said turret having a tubular weapon mounted therein so that the bore axis of the barrel of said weapon, which bore axis is the effective path of the recoil force of said weapon, intersects the vertical rotational axis of said movable turret, and a center of gravity which is always vertically displaced from and below said bore axis and the elevation axis of the cardanic suspension of said turret, but which moves between a first position when the turret is fully loaded with ammunition and a second position when the turret contains no ammunition, the improvement wherein said weapon is mounted in said turret so that said bore axis of the barrel of said weapon lies in between said elevation axis and said center of gravity of said turret and the vertical distance between said bore axis and said elevation axis is approximately equal to the vertical distance between said bore axis and the average position of said center of gravity of said turret, whereby the torque exerted on said turret during firing is reduced.

3. The apparatus defined in claim 2 wherein the cardanic suspension of said turret includes a tilt bearing for permitting movement of said turret about the tilt axis of the cardanic suspension and wherein the support arms for said tilt bearing extend upwardly into said turret above the plane of said center of gravity.

* * * * *